US005536006A

United States Patent [19]

Shieh

[11] Patent Number: 5,536,006

[45] Date of Patent: Jul. 16, 1996

[54] GOLF CLUB HEAD

[76] Inventor: Tien W. Shieh, No. 119, Peiping Road, Fengshan, Kaohsiung, Taiwan

[21] Appl. No.: 550,647

[22] Filed: Oct. 31, 1995

[51] Int. Cl.[6] ..... A63B 53/04

[52] U.S. Cl. ..... 473/342; 473/350

[58] Field of Search ..... 273/167 R, 167 H, 273/173, 167 J, 78, 79, 169, 167 F, 77 R, 77 A, 167 A, 175, 174, 193 R

[56] References Cited

U.S. PATENT DOCUMENTS

| | | | |
|---|---|---|---|
| 4,573,685 | 3/1986 | Young | 273/173 |
| 4,749,197 | 6/1988 | Orlowski | 273/167 H |
| 5,064,197 | 11/1991 | Eddy | 273/173 |
| 5,106,094 | 4/1992 | DesBiolles | 273/167 H |
| 5,303,922 | 4/1994 | Lo | 273/173 |
| 5,431,396 | 7/1995 | Shieh | 273/167 H |
| 5,433,440 | 7/1995 | Lin | 273/167 H |

*Primary Examiner*—Sebastiano Passaniti
*Attorney, Agent, or Firm*—Jones, Tullar & Cooper

[57] ABSTRACT

A golf club head including a metal casing having a front open side, and a titanium face plate fastened to the metal casing and covered on the front open side, wherein the face plate has a backward flange and a plurality of radial through holes spaced around the backward flange; the metal casing is directly molded on the face plate, having integral rod portions respectively fitted into the radial through holes of the backward flange of the face plate to fixedly secure the face plate in place.

5 Claims, 3 Drawing Sheets

A

GOLF CLUB HEAD

BACKGROUND OF THE INVENTION

The present invention relates to golf club heads, and relates more particularly to such a golf club head which comprises a metal casing having a front open side, and a titanium face plate fixedly secured to the front open side of the metal casing upon the casting of the metal casing.

The game of golf has become more and more popular in every country. When playing golf, different golf clubs may be used in different conditions. The structure of the head, more particularly the face plate of a golf club has great concern with the performance of the player. FIG. 1 shows the head of a conventional golf club which comprises a casing 10 having a front recess 101, and a face plate 30 fitted into the front recess 101 of the casing 10 and fixedly secured in place by screws 20. When the screws 20 are installed, the heads of the screws 20 cannot be maintained in flush with the face plate 30 perfectly. If the heads of the screws 20 are not maintained in flush with the face plate 30 perfectly, the commercial value of the club head is greatly reduced. In order to eliminate the aforesaid problem, the face plate 30 may be directly fastened to the front recess 101 of the casing 10 by a glue. Directly adhering the face plate 30 to the front recess 101 of the casing 10 can maintain the front side of the face plate 30 in a smooth manner. However, the face plate 30 tends to fall from the casing 10 upon a strong impact force.

SUMMARY OF THE INVENTION

The present invention has been accomplished to provide a golf club head which eliminates the drawbacks of the aforesaid conventional golf club heads. According to one aspect of the present invention, the golf club head is comprised of a metal casing having a front open side, and a titanium face plate fastened to the metal casing and covered on the front open side, wherein the face plate has a backward flange and a plurality of radial through holes spaced around the backward flange; the metal casing is directly molded on the face plate, having integral rod portions respectively fitted into the radial through holes of the backward flange of the face plate to fixedly secure the face plate in place. According to another aspect of the present invention, the face plate has a tapered outer diameter gradually reducing toward the front side, and the periphery of the front open side of the metal casing engages the tapered outer diameter of the face plate in flush with the front side of the face plate.

DETAILED DESCRIPTION OF THE PREFERRED EMBODIMENT

Figure 1:
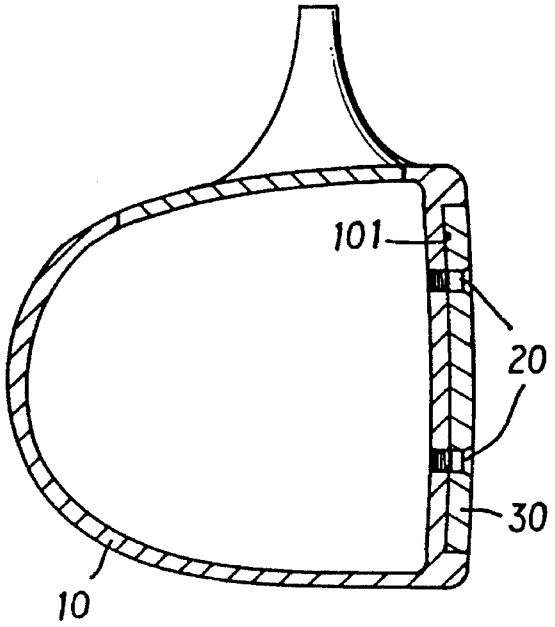
FIG. 1 (PRIOR ART)
FIG. 1 is a sectional view of a golf club head according to the prior art.
Figure 2:
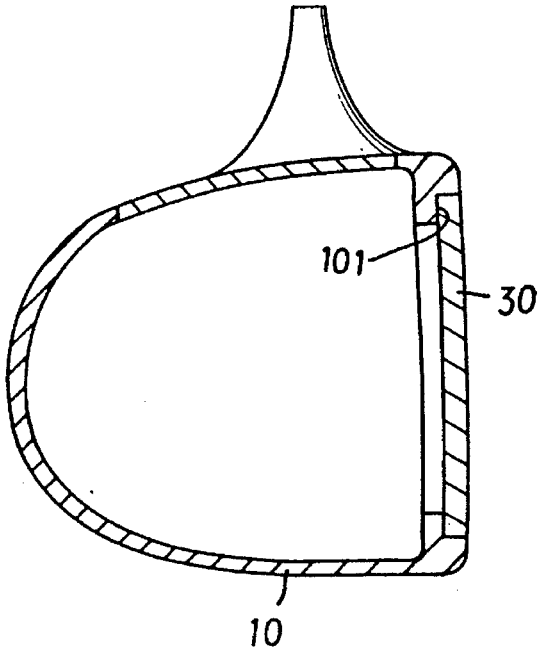
FIG. 2 (PRIOR ART)
FIG. 2 is a sectional view of another structure of golf club head according to the prior art.
Figure 3:
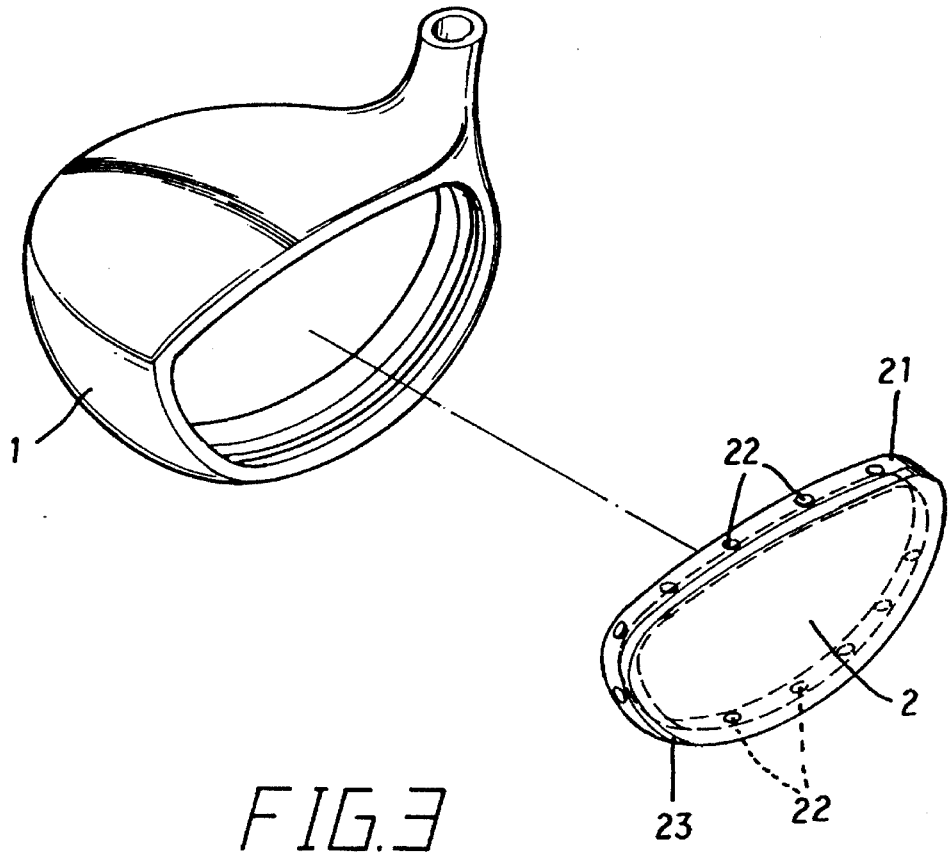
FIG. 3 is an exploded view of a golf club head according to the present invention.
Figure 4:
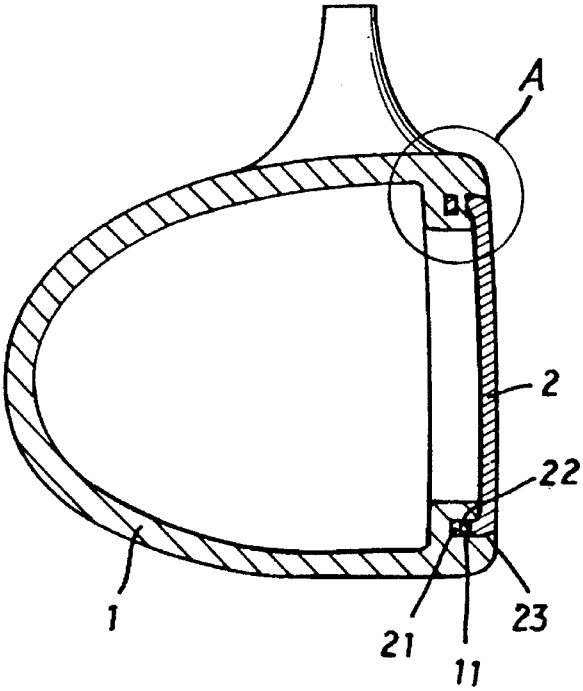
FIG. 4 is a sectional assembly view of the golf club head shown in FIG. 3.
Figure 5:
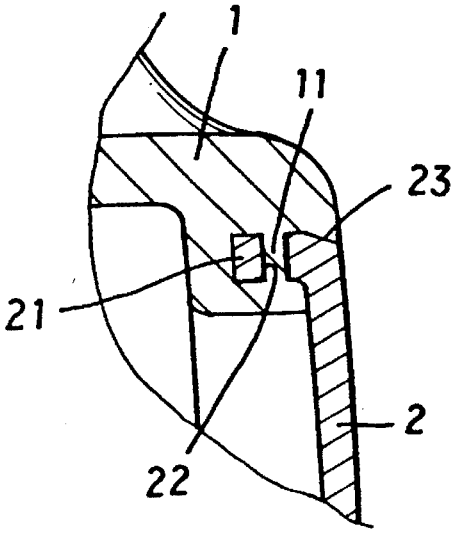
FIG. 5 is an enlarged view of part A of FIG. 4.
Figure 6:
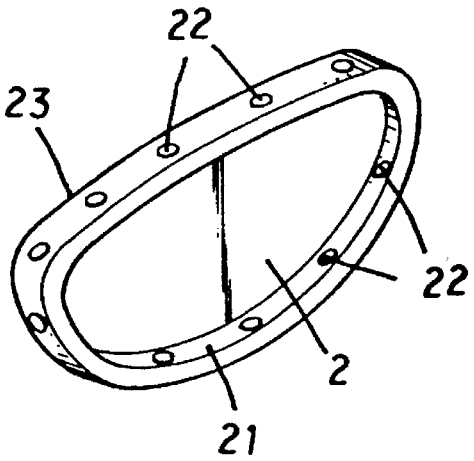
FIG. 6 is an elevational view of the face plate shown in FIG. 3 taken from another direction.

Referring to FIGS. 3 and 4, a golf club head in accordance with the present invention is generally comprised of a metal casing 1, and a face plate 2 fastened to the front side of the metal casing 1 for hitting the ball. The face plate 2 is made from titanium having a backward flange 21 perpendicularly raised from the back side around the border (see FIG. 6). The backward flange 21 has a plurality of radial through holes 22. Furthermore, the face plate 2 has a tapered outer diameter 23 gradually reducing toward the front side. When the face plate 2 is made, it is put in a die casting mold, and then a molten metal such as, for example, liquid aluminum or stainless steel is poured into the mold to cast the metal casing 1 on the face plate 2. When the metal casing 1 is molded, integral rod portions 11 are formed on the metal casing 1 and fitted into the radial through holes 22 to fixedly secure the face plate 2 to the metal casing 1, and the periphery of the front open side of the metal casing 1 engages the tapered outer diameter 23 of the face plate 2 in flush with the front side of the face plate 2.

It is to be understood that the drawings are designed for purposes of illustration only, and are not intended as a definition of the limits and scope of the invention disclosed.

I claim:

1. A golf club head comprising a metal casing having a front open side defining an outer periphery and a face plate fastened to said metal casing, said face plate covering said front open side, said face plate comprising a front side, a backside and a border and further having a backward flange perpendicularly raised from said backside with said flange extending along said border of said face plate to form a periphery of said face plate, said flange including a plurality of radial through holes spaced along the extent of said flange; said metal casing being directly molded on said face plate, said metal casing having integral rod portions respectively fitted into said radial through holes of said backward flange of said face plate.

2. The golf club head of claim 1 wherein the periphery of said face plate includes a gradually reducing taper from said backside toward said front side; said metal casing engaging the gradually reducing taper of the periphery of said face plate, wherein said front side of said face plate flushingly engages the outer periphery of said metal casing.

3. The golf club head of claim 1 wherein said metal casing is made from aluminum.

4. The golf club head of claim 1 wherein said metal casing is made from stainless steel.

5. The golf club head of claim 1 wherein said face plate is made from titanium.

* * * * *